US006019057A

United States Patent [19]

Hystad

[11] Patent Number: 6,019,057

[45] Date of Patent: Feb. 1, 2000

[54] STOPPING AND RETAINING DEVICE FOR CHAIN OR WIRE

[75] Inventor: Serina Hystad, Kopervik, Norway

[73] Assignee: Bryns Patentkontor A/S, Norway

[21] Appl. No.: 08/983,216

[22] PCT Filed: Jul. 11, 1996

[86] PCT No.: PCT/NO96/00175

§ 371 Date: Mar. 3, 1998

§ 102(e) Date: Mar. 3, 1998

[87] PCT Pub. No.: WO97/02978

PCT Pub. Date: Jan. 30, 1997

[30] Foreign Application Priority Data

Jul. 12, 1995 [NO] Norway ..... 952771

[51] Int. Cl.[7] ..... B63B 21/08

[52] U.S. Cl. ..... 114/199

[58] Field of Search ..... 114/199, 200, 114/210, 218, 230, 293

[56] References Cited

U.S. PATENT DOCUMENTS 4,423,697 1/1984 Royset ..... 114/199

4,458,631 7/1984 Hystad ..... 114/199

*Primary Examiner*—Ed Swinehart

*Attorney, Agent, or Firm*—Dorsey & Whitney, LLP

[57] ABSTRACT

A device on board a vessel for stopping and retaining either a link (2", 11") in a chain (2; 11) or a clamp on a wire, where the chain or wire is intended to be extended between the vessel and, e.g., an anchor, comprising a grip and stop fork (1) which is designed such that it may be brought up through the vessel deck (6) to engage with said chain link or wire clamp, and where the opening between the outer section of the fork teeth (1', 1") may optionally be closed off with a locking bolt or similar means. The fork (1) has a first, effective locking height ($h_1$) above the deck of the vessel, defined by the bottom (14) of the opening between the fork teeth and intended for a chain (2) lying within a first size range, and a second, effective locking height ($h_2$) above the vessel deck intended for chain (11) or wire lying within a second, smaller size range, said second locking height ($h_2$) being greater than said first locking height ($h_1$). The fork is moreover designed with guide members (12) and a shoulder (13) for the mounting and securing of a U-shaped insert piece (10) in the opening between the fork teeth, the bottom of said insert piece defining said second locking height.

5 Claims, 6 Drawing Sheets

STOPPING AND RETAINING DEVICE FOR CHAIN OR WIRE

RELATED APPLICATIONS

This application claims the priority of PCT Application No. PCT/NO96/00175, filed Jul. 11, 1996 and Norwegian Application No. 952771, filed Jul. 12, 1995, which are incorporated herein by reference.

SUMMARY OF THE INVENTION

The present invention relates to a device on board a vessel for stopping and retaining either a link in a chain or a clamp on a wire, where the chain or wire is intended extend stretched between the vessel and, e.g., an anchor, comprising a grip and stop fork which is designed such that it may be brought up through the vessel deck to engage with said chain link or wire clamp, and where the opening between the outer section of the fork teeth may optionally be closed off with a locking bolt or similar means.

A device of the type introduced above is known from, for example, Danish Patent No. 260004. A somewhat more comprehensive variant of this known device is apparent from Norwegian Patent No. 152641.

Recently, however, a need has arisen for stopping and retaining devices capable of handling chain or wire having a diameter in the range of up to about 170 mm. The same stoppers must also be utilizable for chain or wire of a dimension down to about 50 mm. For this to be possible, such a device must not have too large a diameter, as a chain of small dimensions would otherwise risk being drawn down into the guide tube conduit of the stopping device. It is thus important that the distance between the teeth of the grip and stop fork be correctly gauged, and that the depth of the opening between the teeth be great enough to allow space for a chain having a diameter of 170 mm, and also that there be sufficient space for a locking bolt at the free end of the fork teeth.

According to the invention, the device introduced above is characterized in that the fork has a first, effective locking height above the deck of the vessel, defined by the bottom of the opening between the fork teeth and intended for a chain lying within a first size range, and a second, effective locking height above the vessel deck intended for chain or wire lying within a second, smaller size range, said second locking height being greater than said first locking height, and that the fork is designed with guide members and a shoulder for the mounting and securing of a U-shaped insert piece in the opening between the fork teeth, the bottom of said insert piece defining said second locking height. According to further embodiments of the device, it is advantageous that said guide members are tapered in the direction away from said shoulder, and that the shoulder is spaced a distance above the bottom of the fork opening.

It is advantageous that the U-shaped insert piece be provided at the free ends thereof with holes corresponding to axially arranged holes in the teeth of the fork for the optional insertion of a locking bolt on the insert piece.

The invention will now be explained in more detail with reference to the enclosed drawings.

DETAILED DESCRIPTION OF THE PREFERRED EMBODIMENTS

Figure 1:
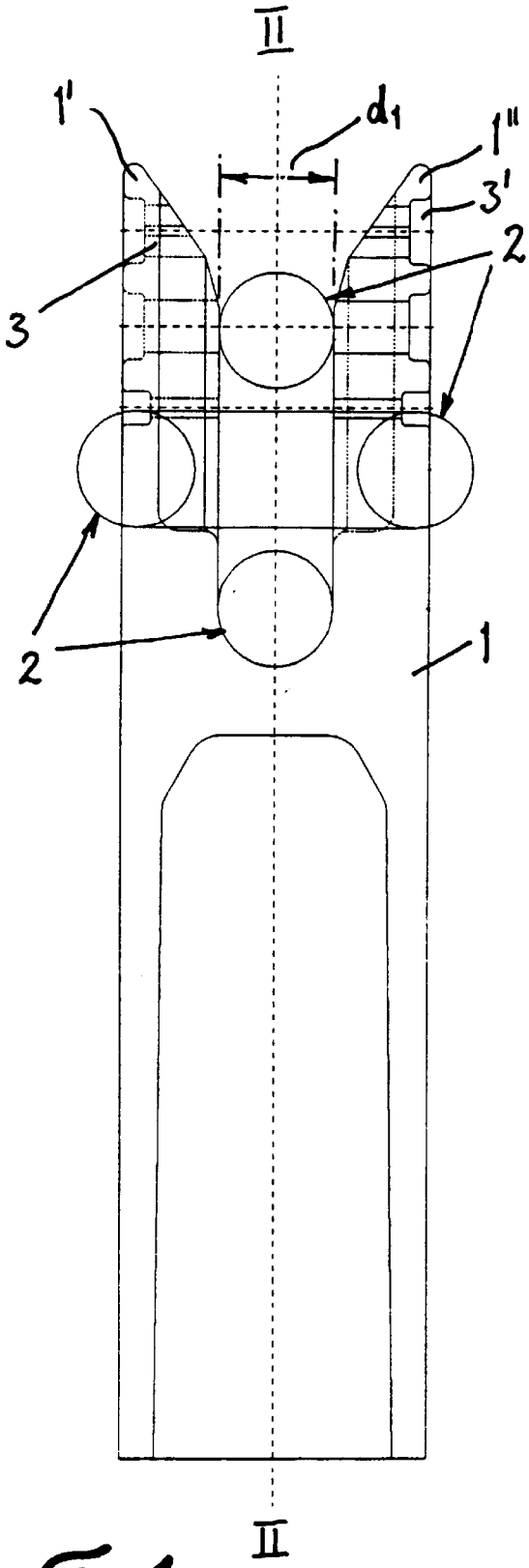
FIG. 1 is a schematic elevational view of the device, according to the invention.

In FIG. 1 is shown a grip and stop fork 1, with a chain 2 positioned in fork 1, where the chain has a diameter of about 170 mm, so that the distance $d_1$ between the fork teeth 1', 1" is equal to or slightly greater than the maximum diameter of the chain. Fork 1 is designed so that the horizontal chain link, as indicated by reference numeral 2' in FIGS. 5 and 6, will rest against grip and stop fork 1. Horizontal chain link 2' will be prevented from twisting, inasmuch as the adjacent vertical chain link 2" is situated in the opening between fork teeth 1' and 1". The supported, vertically situated chain link 2" thus ensures that the horizontal chain link 2' is unable to twist to one side or the other about its longitudinal axis.

Grip and stop fork 1 is, at the outset, constructed such that chains of a diameter in the range of 110 mm–170 mm will be stopped directly against fork 1 without any U-shaped insert piece having been placed therein, and at a lower height $h_1$ above the vessel deck than what would be the case for chain or wire dimensions smaller than 110 mm.

Although it is described that the device, according to the invention, would be applicable for chains in the dimensional range of 110 mm–170 mm, it will be immediately understood that the invention cannot be considered to be limited to this range of chain dimension, as the use with chains of a somewhat larger dimension, or optionally a slightly smaller dimension, would also be conceivable within the scope of the invention.

When the vertical chain link 2" is situated between fork teeth 1' and 11", it may optionally be advantageous to ensure that this chain link does not move out of the fork. For this purpose, holes 3 and 3' are provided in the fork teeth at the respective outer ends thereof for the insertion of a locking bolt or the like (not shown).

Figure 2:
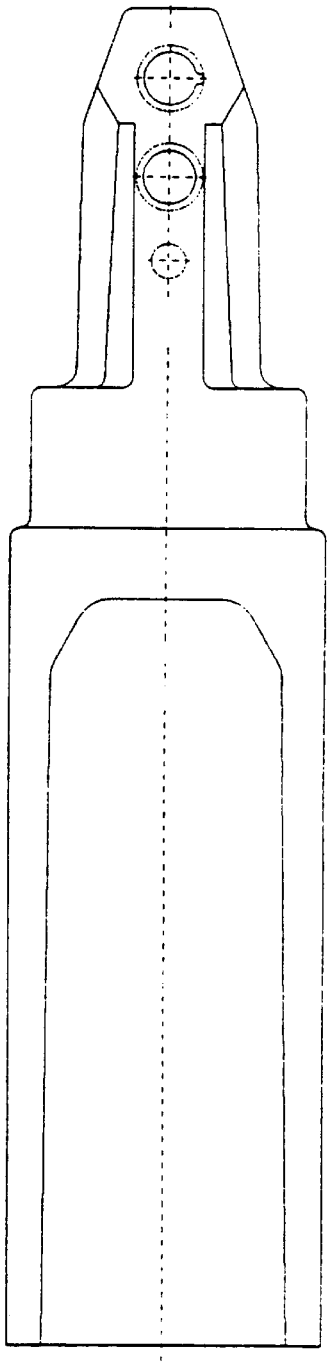
FIG. 2 is a view of the device of FIG. 1 along the line II—II.
Figure 5:
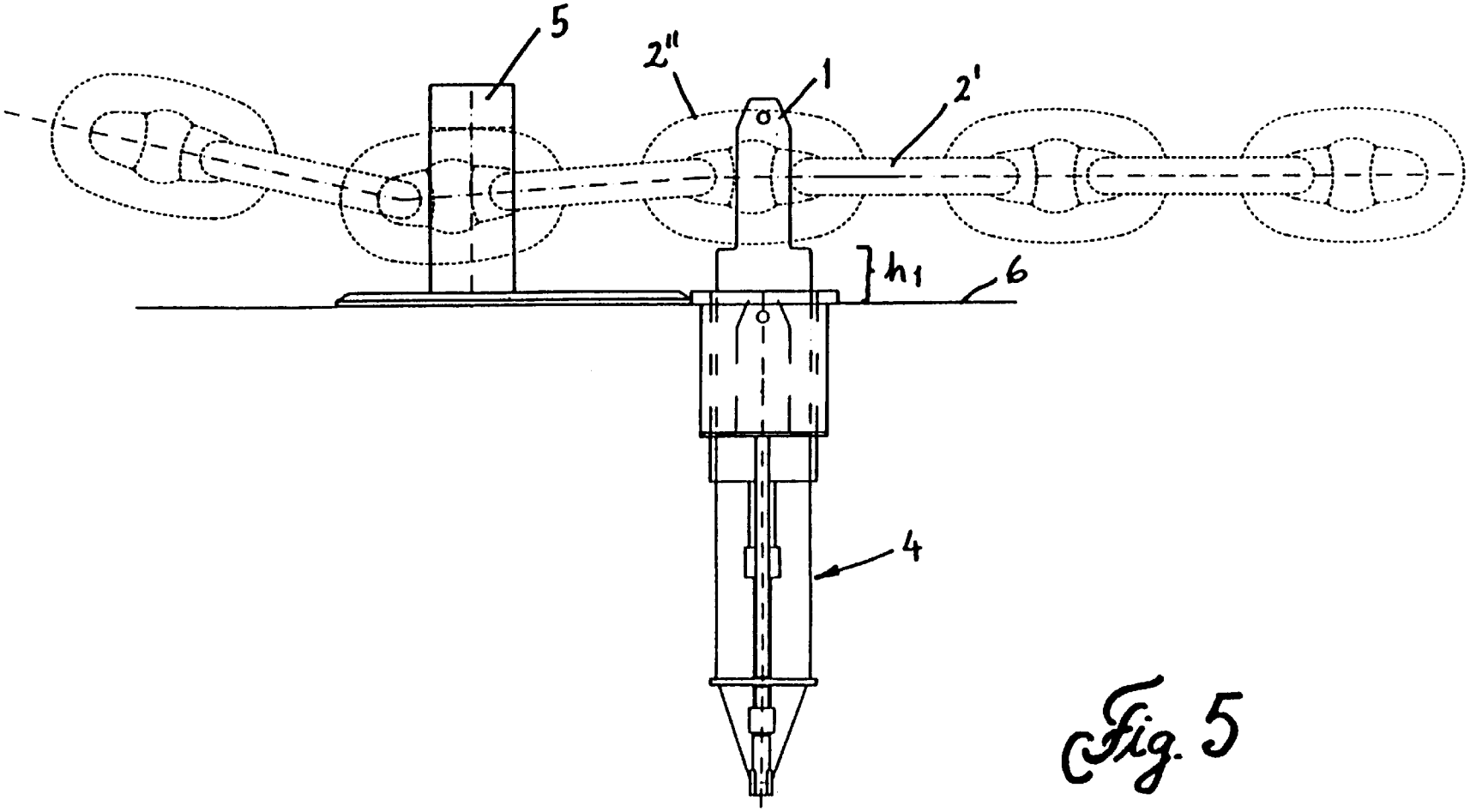
FIG. 5 shows the device, according to the invention, being used with a chain of large dimension and employing one type of towing pins.

In the embodiment in FIG. 5, the device of FIGS. 1 and 2 has been provided with raising and lowering capability in a vertical direction by means of a lifting mechanism 4, e.g., of the hydraulic type or of the nut/screw type.

Together with the device, according to the invention, the embodiment of FIG. 5 is shown being used with a pair of known per se towing pins 5 arranged in a stationary position on the vessel deck.

Figure 6:
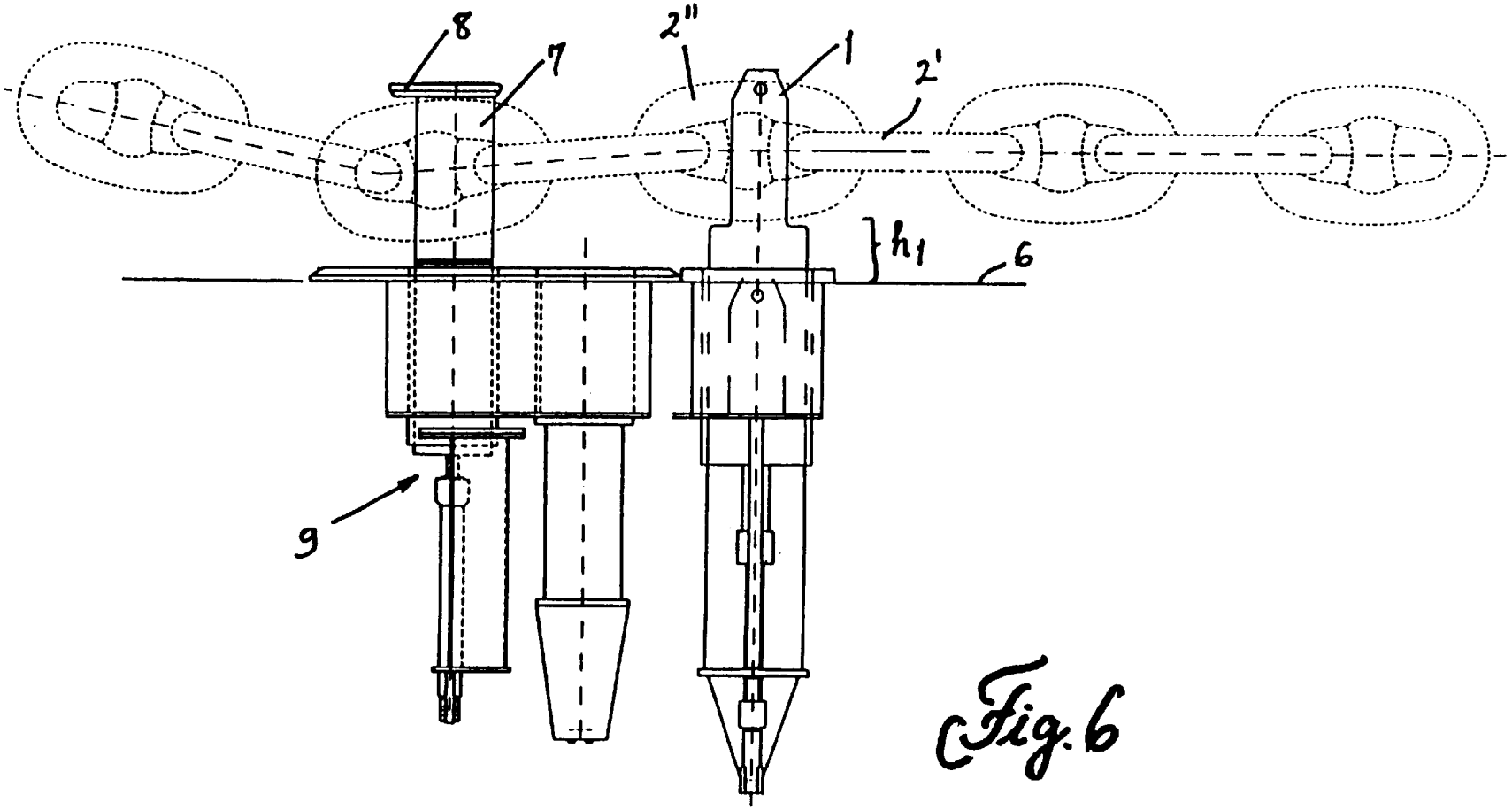
FIG. 6 shows a variant of FIG. 5, wherein the device, according to the invention, employs a second type of towing pins.

In the alternative embodiment shown in FIG. 6, the tpwing pins are designated by reference numeral 7 and are designed as towing pins having raising and lowering capability, and which cable pins are equipped with locking members 8, or so-called "flaps," which rotate toward one another in order to lie over the opening between towing pins 7 when they are in their uppermost position. The towing pins are provided with a raising and lowering mechanism 9 which causes towing pin 7 to rotate at the same time as the pins are raised or lowered. Such a raising and lowering mechanism as well as towing pins of this type having locking members are known per se. Said locking members or "flaps" also prevent the chain from being drawn up over towing pins 7.

The device, according to the invention, will now be explained in more detail with reference to FIGS. 3, 4 and 7. This solution is intended to be used for a chain of a smaller dimension, e.g., in the range of 50 mm–105 mm, or optionally for wire having a diameter of up to 140 mm. The stated dimensional ranges, however, should be regarded merely as guidelines and should not be perceived as a limitation to the scope of the invention.

Figure 3:
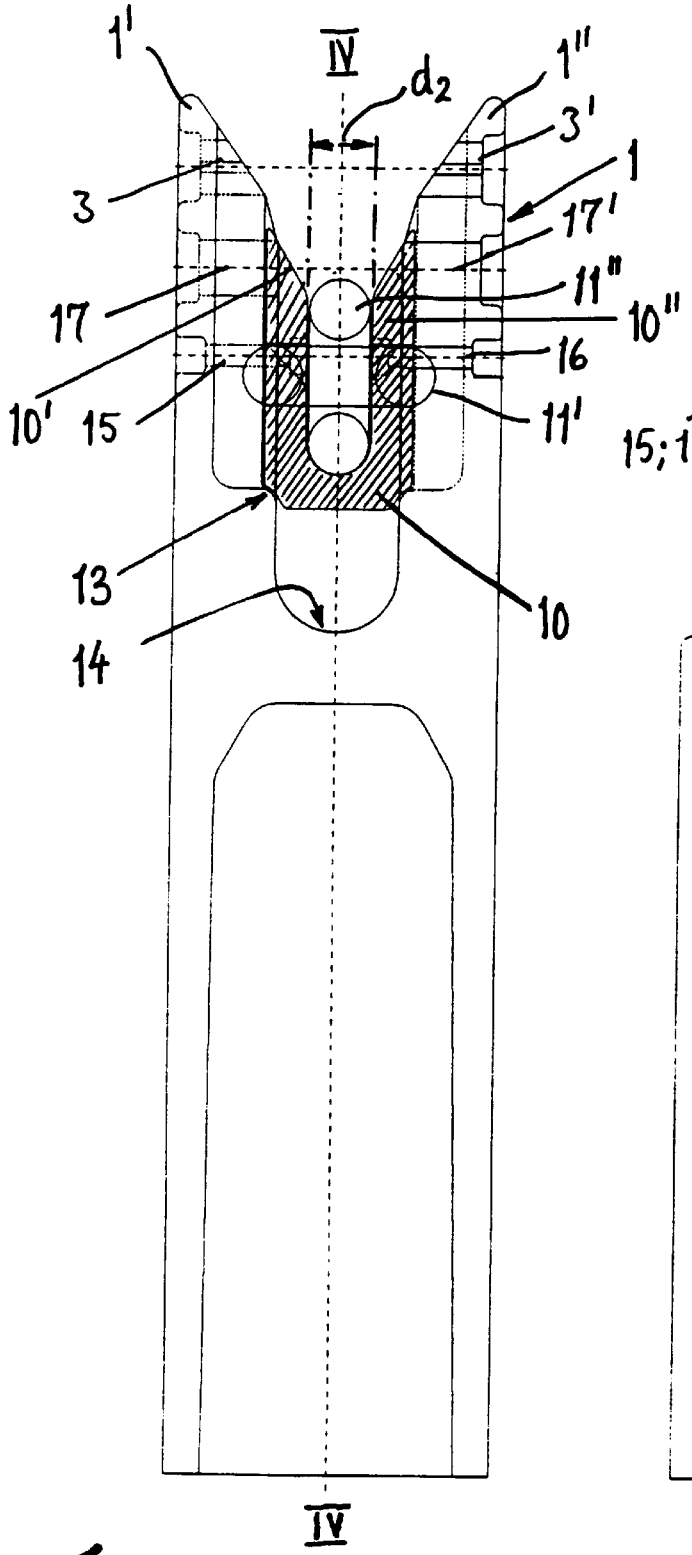
FIG. 3 shows the device according to the invention with the U-shaped insert piece.
Figure 4:
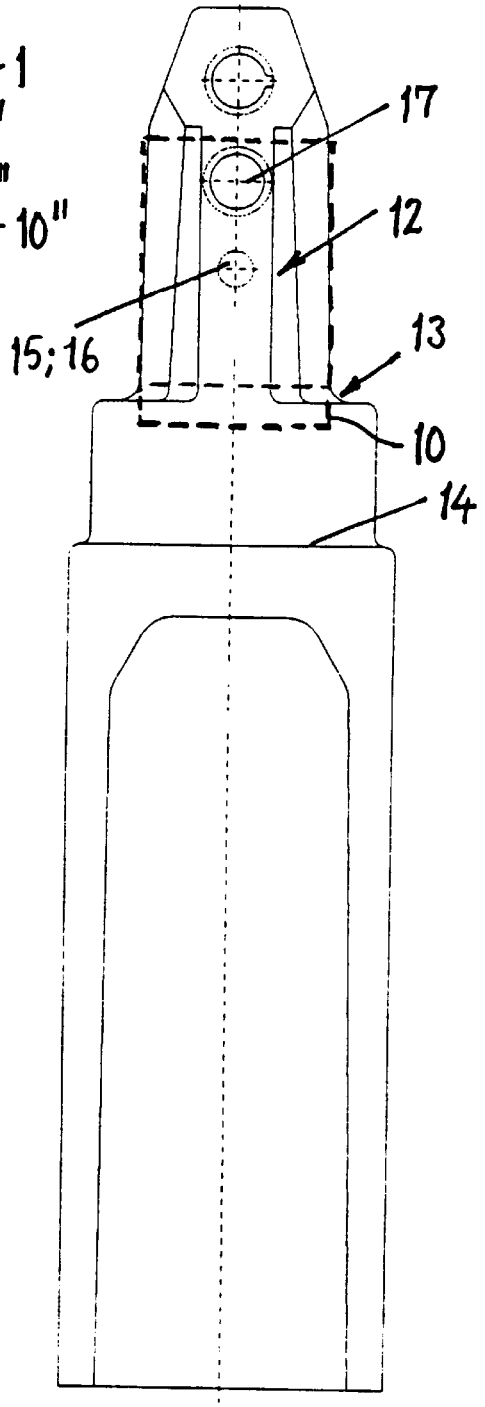
FIG. 4 is a view of the device of FIG. 3 along the line IV—IV.

As shown in FIG. 3, with the use of the device according to the invention and a chain having the slightly smaller dimension in the range of, e.g., 50 mm–105 mm, it will be necessary to employ a U-shaped insert piece 10, indicated by the shaded area in FIG. 3 and by a heavy broken line in FIG. 4. If insert piece 10 should optionally be used in connection with a wire, it would be possible to employ somewhat thinner walls on insert 10, allowing the dimension of the wire to be as great as 140 mm.

Figure 7:
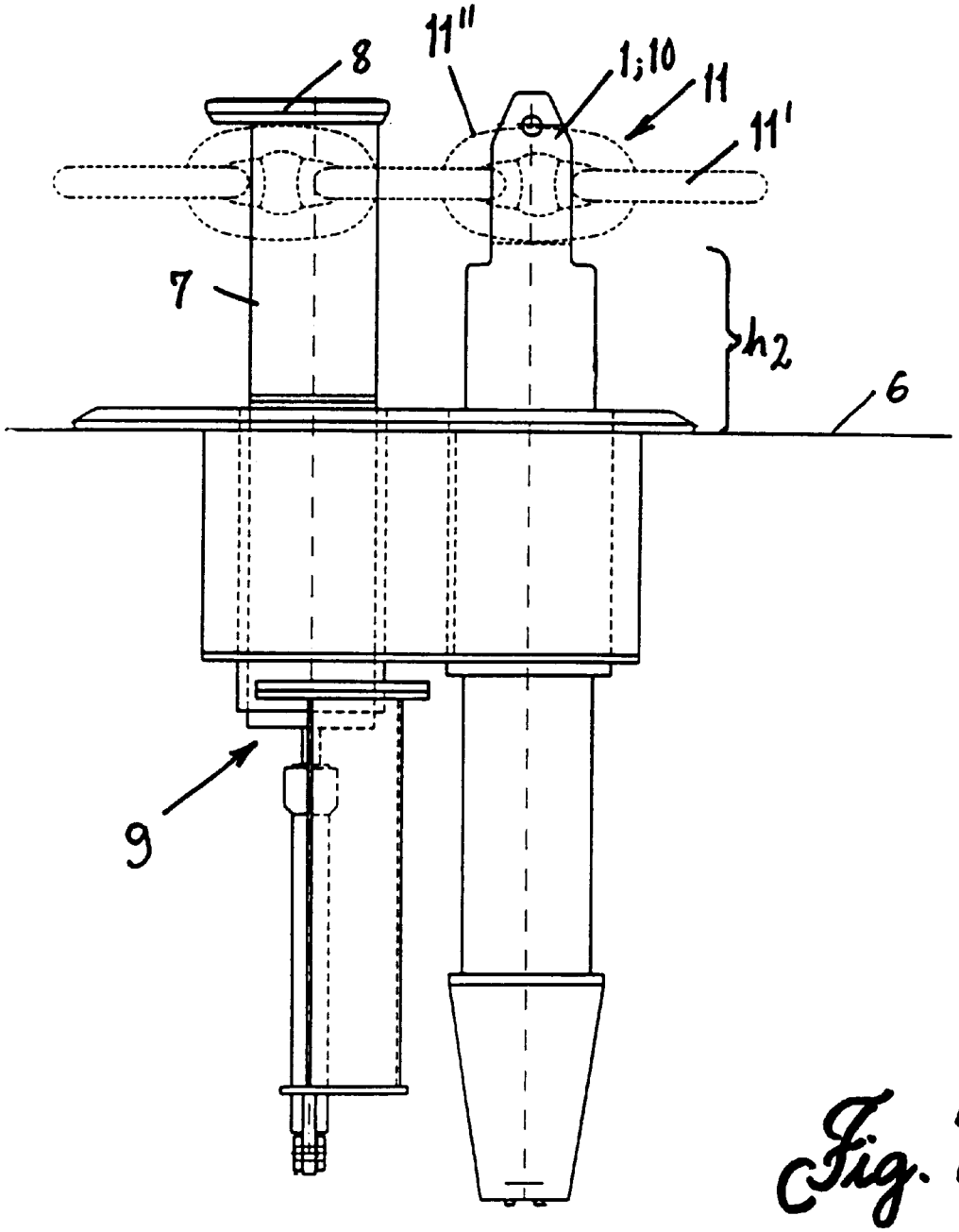
FIG. 7 shows the device, according to the invention, used with a U-shaped insert piece for smaller dimensions of chain.

As will be clearly apparent from FIG. 7, the bottom of the U-shaped insert piece will be situated at a locking height $H_2$ above vessel deck 6. The chain 11 or wire (not shown) within this range having smaller dimensions will consequently be lifted higher up over the deck, which must be regarded as a great advantage during normal anchor handling. It would particularly be advantageous to use the device, according to the invention equipped with U-shaped insert piece 10, in connection with a towing pin arrangement 7, 8 and 9 as shown and described in connection with FIG. 6. The locking members, or said "flaps" 8, on towing pin 7 would be closed over the wire or chain during, e.g., anchor handling. This would prevent the wire or chain from being drawn up from the device according to the invention, which could normally extend about 18–20 cm up above said locking members 8, as is indicated by the top part of FIG. 7.

As shown and explained in connection with FIGS. 5 and 6, the horizontal chain link 11' will rest against fork 1 and its insert piece 10. The vertical chain link or loop 11" will be situated between the arms of said U-shaped insert piece, as indicated by FIG. 3. This allows the horizontal chain link 11' to twist to a considerable degree, since it is well supported against both fork 1 and its insert piece 10, as well as the vertical chain member 11".

The U-shaped insert piece 10 engages with guide members 12 on fork 1, and these guide members 12, as indicated by FIG. 4, are tapered in the direction away from a shoulder 13 situated above the bottom 14 of the fork opening.

To hold U-shaped insert piece 10 in place, mounting holes 15 and 16 are provided in each of the fork teeth 1' and 1", into which holes may be inserted fixing screws (not shown) which optionally may threadably engage with insert piece 10.

Further, said teeth 1' and 1" on fork 1 may be provided with axially arranged holes 17 and 17' for cooperation with an optional locking bolt to prevent a chain or wire from moving completely out of insert piece 10.

The distance between the two branches 10' and 10" on U-shaped insert piece 10 is designated by $D_2$ and corresponds to the largest dimension within the second, lower dimensional range for said chain or wire.

The device according to the invention for stopping and retaining a chain link in a chain or a clamp on a wire may be constructed with a horizontal cross-sectional dimension that is relatively small, e.g., in the range of about 45–50 cm.

The device according to the invention thus displays the advantage of permitting two locking heights above the vessel deck, where the first locking height above the deck is provided by using a U-shaped insert piece to lock a chain or wire with a diameter in the range of, e.g., 50–105 mm, or a specially designed U-shaped insert for only wire having a dimension of up to about 140 mm. The lowest locking height above the vessel deck permits the locking of a chain having a diameter in the range of about 110–180 mm.

When we have a chain of large diameter and this chain is locked to fork 1, there will be the shortest possible momentum arm for the forces exerted on the forks. Moreover, the resistance momentum for the fork for the cross-section that is under most stress in this instance is maximal.

Figure 8:
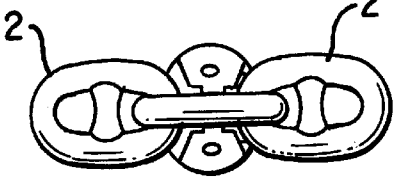
FIG. 8 illustrates a top view of FIG. 1.

FIG. 8 shows a top view of the grip and stop fork 1 with the chain 2 positioned in the grip and stop fork 1.

Figure 9:
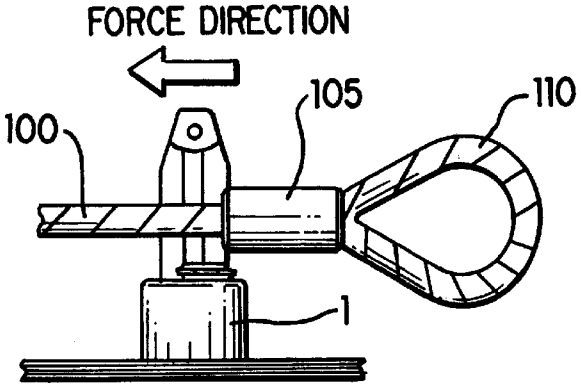
FIG. 9 illustrates an elevational view of a second embodiment of the present device.
Figure 10:
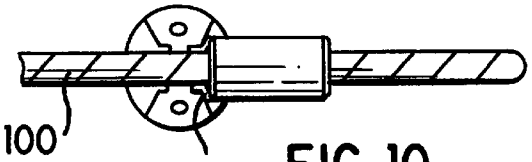
FIG. 10 illustrates a top view of FIG. 9.

FIG. 9 shows another embodiment of the grip and stop fork 1. The grip and stop fork 1 includes a wire 100 which goes through the fork 1. One end of the wire 100 forms a wire loop 110. The wire loop 110 is formed by adding a wire clamp 105 to that end of the wire 100.

When we have a chain or wire of a diameter in the range of, e.g., 50–105 mm, alternatively up to 140 mm, there is provided an upper locking bed having a locking height of $h_2$, where the previously mentioned U-shaped insert is mounted in an upper part of fork 1. This thereby provides a greater locking height above the vessel deck, which is a major advantage in regular anchor handling with chain or wire dimensions within the relevant range.

The U-shaped insert 10 is constructed so that there is little clearance, maximum 10 mm, between it and vertical chain link 11" that is supported by means of the horizontal chain loop or link 11'. The forces that would seek to burst fork 1 are thereby reduced in considerable degree.

I claim:

1. In a device on board a vessel having a vessel deck, for stopping and retaining either a link in a chain or a clamp on a wire, wherein the chain or wire is intended to extend between the vessel and an anchor, said device comprising:

a grip and stop fork, said fork having a pair of teeth with an opening therebetween, said opening having a bottom, and wherein said fork may be brought up through said vessel deck to engage with said link or said clamp, and wherein said opening between may optionally be closed off with a locking bolt; the improvement comprising;

said fork having a first effective locking height above said vessel deck defined by said bottom of said opening and intended for retaining a chain or wire lying within a first size range; and said fork having a second effective locking height above said vessel deck intended for retaining a chain or wire lying within a second size range which is smaller than said first size range;

said second locking height being greater than said first locking height, relative to said vessel deck; and wherein said fork includes a bottom and at least one guide member for mounting and securing a U-shaped insert in said opening between the fork teeth, said insert having a bottom defining said second locking height.

2. A device according to claim 1, wherein said insert bottom is spaced at a distance above said bottom of said fork opening.

3. A device according to claim 1, wherein said fork further includes a shoulder spaced at a distance above the said bottom of said fork opening.

4. A device according to claim 3 wherein said guide member is tapered in a direction away from said shoulder.

5. A device according to claim 1, wherein said fork teeth have holes axially arranged therein and said U-shaped insert has free ends, said free ends provided with holes corresponding to said fork teeth holes for said optional insertion of said locking bolt.

* * * * *

UNITED STATES PATENT AND TRADEMARK OFFICE

CERTIFICATE OF CORRECTION

PATENT NO. : 6,019,057
DATED : February 1, 2000
INVENTOR(S) : Per Hystad (Deceased)

It is certified that error appears in the above-identified patent and that said Letters Patent is hereby corrected as shown below:

Title page,
Item [75], Inventor: please change "Serina Hystad," to read -- Per Hystad (Deceased), --;
Item [73], Assignee: please change "Bryns Patentkontor A/S, Norway" to read -- Karmoy Winch A/S, Norway --; and Specifications, column 1,
Line 62, please change "DRAWING" to read -- DRAWINGS --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*